US007122021B2

(12) United States Patent
Ahlström et al.

(10) Patent No.: US 7,122,021 B2
(45) **Date of Patent: *Oct. 17, 2006**

(54) EYE RINSING DEVICE

(75) Inventors: Tom Ahlström, Lidingö (SE); Hans Ehrich, Stockholm (SE); Jochen Ratjen, Stockholm (SE)

(73) Assignee: Cederroth International AB, Upplands Vasby (SE)

( * ) Notice: Subject to any disclaimer, the term of this patent is extended or adjusted under 35 U.S.C. 154(b) by 360 days.

This patent is subject to a terminal disclaimer.

(21) Appl. No.: 10/343,905

(22) PCT Filed: Oct. 16, 2001

(86) PCT No.: PCT/SE01/02247

§ 371 (c)(1),
(2), (4) Date: Sep. 3, 2003

(87) PCT Pub. No.: WO02/32370

PCT Pub. Date: Apr. 25, 2002

(65) Prior Publication Data

US 2004/0078010 A1 Apr. 22, 2004

(30) Foreign Application Priority Data

Oct. 16, 2000 (SE) ..... 0003730

(51) Int. Cl.
*A61H 35/02* (2006.01)
*B65D 49/12* (2006.01)

(52) U.S. Cl. ..... 604/301; 215/48; 215/49

(58) Field of Classification Search ..... 604/1–3, 604/289–90, 294–302, 310; 222/420, 541.1–541.9; 215/47–49

See application file for complete search history.

(56) References Cited

U.S. PATENT DOCUMENTS

| | | | | | |
|---|---|---|---|---|---|
| 1,623,454 | A | * | 4/1927 | Wilson | 604/301 |
| 3,945,381 | A | * | 3/1976 | Silver | 604/301 |
| 4,981,479 | A | * | 1/1991 | Py | 604/302 |
| 6,164,450 | A | * | 12/2000 | Benedetti | 206/570 |
| D467,108 | S | * | 12/2002 | Ahlstrom et al. | D6/545 |
| 6,540,726 | B1 | * | 4/2003 | Follman et al. | 604/294 |

FOREIGN PATENT DOCUMENTS

| | | | |
|---|---|---|---|
| EP | 998895 | A1 * | 5/2000 |
| FR | 2659297 | A1 * | 9/1991 |
| GB | 2392151 | A * | 2/2004 |

* cited by examiner

*Primary Examiner*—Karin Reichle
(74) *Attorney, Agent, or Firm*—Alfred J. Mangels

(57) ABSTRACT

An eye rinsing device including a flask that contains an eye rinsing liquid and that is sealed by a closure element that projects up from the future opening of the flask. The flask includes an eye cup and is adapted to co-act with a flask holder. The eye cup is situated around the closure element and a sleeve surrounds the eye cup. The sleeve is non-rotatably affixed in the closure element. After the flask has been opened, by twisting the sleeve relative to the flask, it is difficult to return the flask to the holder.

10 Claims, 5 Drawing Sheets

EYE RINSING DEVICE

BACKGROUND OF THE INVENTION

1. Field of the Invention

The present invention relates to an eye rinsing device.

2. Description of the Related Art

A number of different eye cleansing devices which include flasks containing eye rinsing liquid for use in acute circumstances and even in other circumstances are known to the art. These flasks are often placed in a holder and removed therefrom when needed, wherein certain flasks are opened as they are taken from the holder. Such flasks are often equipped with an eye cup into which liquid runs from the flask.

A known flask hangs vertically from a protective bar or strip, although, in this case, the eye cup is exposed to impure and contaminated air. The flask can be removed whole from the holder, in the reverse manner in which it is inserted into the holder. However, the flask is opened when removed from the holder in the manner intended.

However, it is desirable in the case of such flasks that the eye cup and its immediate surroundings are free from contaminants, so that no contaminants will enter the user's eye when using the eye rinse.

It is also desired that the flask will open automatically and be ready for use as it is taken from the holder, and that the flask can be opened with a simple hand manipulation when not located in a holder.

Thirdly, it is also desired that the flask can be returned to the holder only with difficulty; this because of possible contamination of the contents of an open flask later used to rinse the eyes of the user.

It is also desired that the flask will not be theft attractive, which is the case when an unopened flask can be removed from the holder and taken home, for instance.

Flasks constructed in accordance with known technology do not satisfy all of these desiderata at the same time.

SUMMARY OF THE INVENTION

The present invention relates to a flask whose eye cup is protected and which can be readily opened by withdrawing the flask from its holder, which can be readily opened outside the holder, which is difficult to put back into the holder after use, and which is not theft attractive.

The present invention thus relates to an eye rinsing device in the form of a flask that contains an eye rinsing liquid and which is sealed by a closure element that projects up from the future opening of the flask. The flask further includes an eye cup and is adapted to co-act with a flask holder. The eye cup is located around the closure element and the eye cup is surrounded by a sleeve that is non-rotatably attached to the closure element.

BRIEF DESCRIPTION OF THE DRAWINGS

The invention will now be described in more detail with reference to an exemplifying embodiment thereof and also with reference to the accompanying drawings, in which.

DESCRIPTION OF THE PREFERRED EMBODIMENTS

Figure 8:
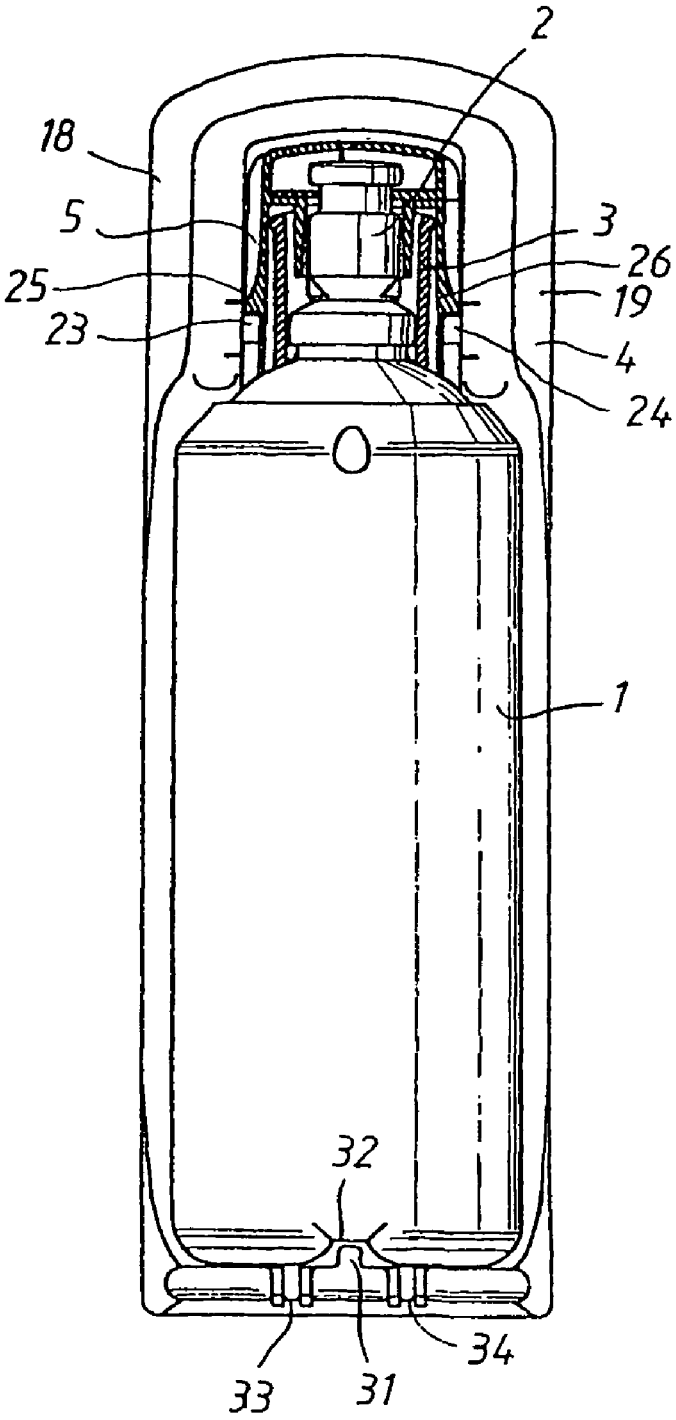
FIG. 8 is a side view of an inventive flask with the upper part of the flask shown in section and the flask being shown inserted in a holder.

FIG. 8 shows an eye rinsing device comprising a flask 1 that contains an eye rinsing liquid. The flask is sealed by a closure element 2 that projects up from the future flask opening. The flask is fitted with an eye cup 3. The device includes a flask holder 4.

Figure 5:
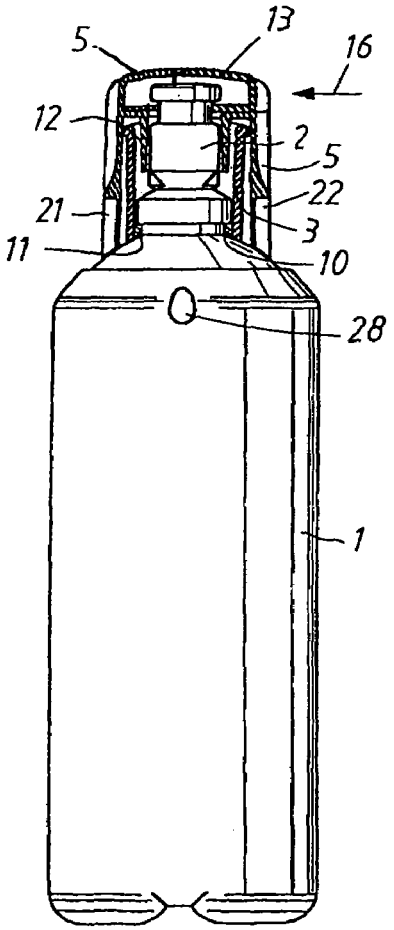
FIG. 5 is a cross-sectional view taken on the line 5—5 of FIG. 3, rotated 180°.
Figure 7:
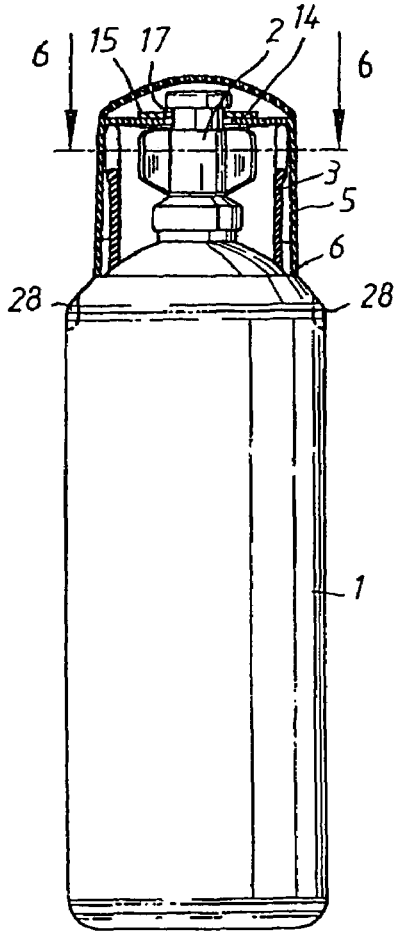
FIG. 7 is a side view of an inventive flask including a partial cross-sectional view, and taken on the line in 7—7 of FIG. 4 and rotated 180°.
Figure 6:
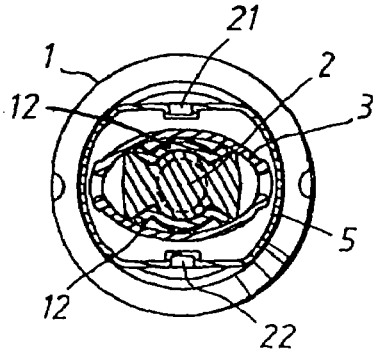
FIG. 6 is a cross-sectional view taken on the line 6—6 of FIG. 7.

According to the invention, the eye cup 3 is located around the closure element 2, see FIGS. 5, 6, and 7.

According to the invention, the device also includes a sleeve 5 that surrounds the eye cup 3. The lower part 6 of the sleeve 5 lies around and against the flask, as shown in FIG. 7. This means that the eye cup will be protected by the sleeve against contamination by dust and dirt for instance. The sleeve 5 is non-rotatably connected with the upper part 7 of the closure element 2.

Figure 1:
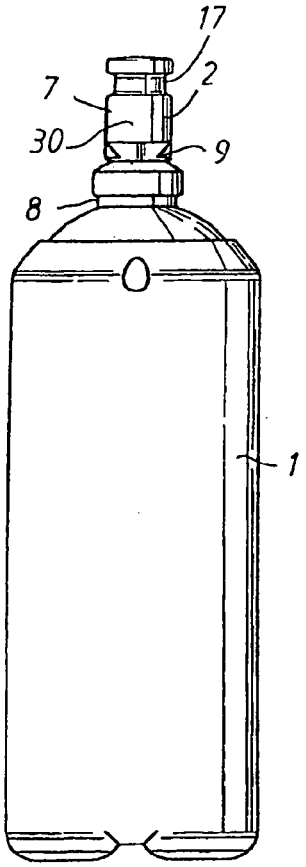
FIG. 1 is a side view of an inventive flask.
Figure 2:
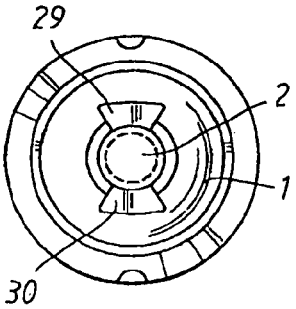
FIG. 2 is a top view of the flask shown in FIG. 1.

According to one preferred embodiment of the invention, the closure element 2 is not axially symmetrical around the longitudinal axis of the flask. In the embodiment of the invention as shown in FIG. 2, the closure element includes two widening wings 29, 30 at the upper part 7. However, the closure element may have a square cross-sectional shape instead. The closure element may, of course, have another non-symmetrical form, such that the flask will be opened when the sleeve, and therewith the closure element, is/are rotated relative to the flask. The closure element 2 includes a waist 8 located beneath said future opening 9, as shown in FIG. 1. The lower portion of the eye cup 3 engages in said waist, as evident from FIG. 5, by virtue of projections 10, 11 provided on the eye cup. The eye cup 3 is thus snapped firmly into the waist region 8 of the flask 1. Moreover, an inner part of the sleeve 5 engages around the non-symmetrical upper part 7 of the closure element 2. This will best be seen from FIGS. 5, 6, and 7, which show that the upper part of the sleeve 5 includes inner, downwardly projecting correspondingly-shaped portions 12 that engage with the axially asymmetric upper part 7 of the closure element 2. The sleeve 5 is also affixed in the closure element by means of a fastener element 13 (see FIG. 4) that co-acts with said closure element. The sleeve 5 is preferably connected with the upper part 7 of the closure element 2.

The sleeve 5 may alternatively be affixed as an element which grips in the lower part of the closure element 2.

Figure 4:
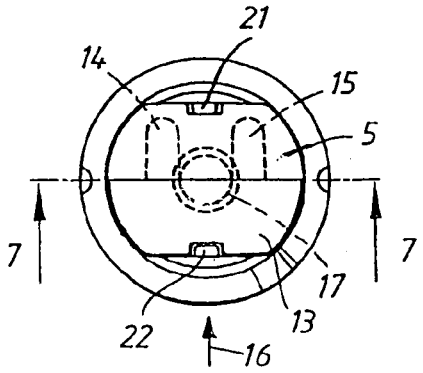
FIG. 4 is a top view of a flask according to FIG. 3, rotated 180°.

The provision of two widening wings 29, 30 on the closure element 2 enables said tubular part 12 to engage effectively with the closure element. The fastener element 13 is generally semi-circular in shape and includes two tongues 14, 15, as shown in FIG. 4. The outer shape of the fastener element 13 corresponds in general to the uppermost part of the sleeve 5. When the fastener element has been inserted to its end position in said sleeve, against the sleeve, in the direction of arrow 16 in FIGS. 4 and 5, the sleeve and the fastener element form a smooth and even unit.

The upper part 7 of the closure element 2 includes a peripherally extending recess 17. When the fastener element 13 is inserted into the sleeve 5, the tongues 14, 15 will lie in abutment with the recess 17, as shown in FIGS. 4, 5, and 7. The sleeve 5 is therewith firmly seated in the flask.

The flask 1 is thus provided with an eye cup 3 that is firmly seated in the flask, and a sleeve 5 which is non-rotatably secured in the flask when the flask is unused.

The flask 1 is produced in a first step in the form of the unit shown in FIG. 1. The flask is filled with an eye rinsing liquid during manufacture of the flask.

Figure 3:
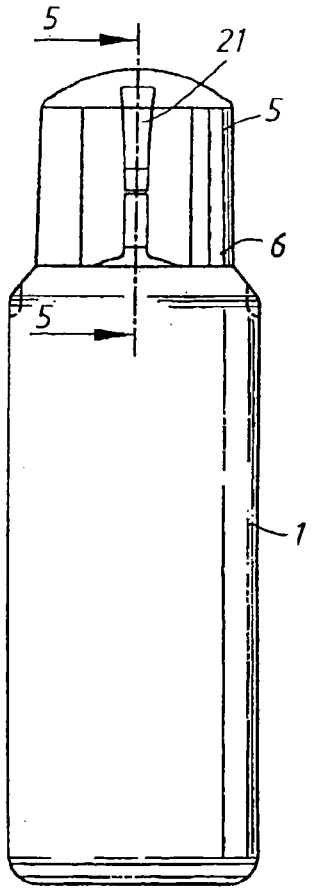
FIG. 3 is a side view of an inventive flask shown in FIG. 1 when provided with a sleeve and rotated 90°.

The flask is then provided with the eye cup 3, whereafter the sleeve 5 is fitted and fastened by means of the fastener element 13, said flask then having the form shown in FIG. 3.

When the flask is to be opened, the flask 1 is rotated relative to the sleeve 5, therewith breaking-off the closure element 2 at the future flask opening 9. The sleeve 5 and the upper part 7 of the closure element 2, which is firmly seated in the sleeve, are thus loosened automatically as the flask is rotated. What remains is the flask 1 with the eye cup 3 attached thereto. The eye cup 3 is then placed over the eye of the user and rinsing liquid flows from the flask when it is turned upside down. The rinsing liquid drains away via V-shaped channels in the short sides of the eye cup.

The inventive flask is adapted to co-act with a flask holder 4, as shown in FIG. 8. The holder 4 includes two mutually spaced and outwardly directed walls 18, 19, between which the sleeve 5 can be fastened. The holder 4 also includes an outwardly directed support 20 against which the bottom of the flask 1 is intended to rest when placed in the holder.

The sleeve 5 includes means for connection of the flask with the flask holder comprising two mutually opposing grooves 21, 22 that extend parallel with the longitudinal axis of the flask, as shown in FIG. 6. The grooves 21, 22 are intended to co-act with a springy projection 23, 24 in each of the outwardly facing walls 18, 19, so as to retain the flask in the holder, as shown in FIG. 8. Each of the grooves 21, 22 is conveniently provided with a shoulder 25, 26 intended for abutment with the springy, or resilient, projections 23, 24, respectively.

Figure 9:
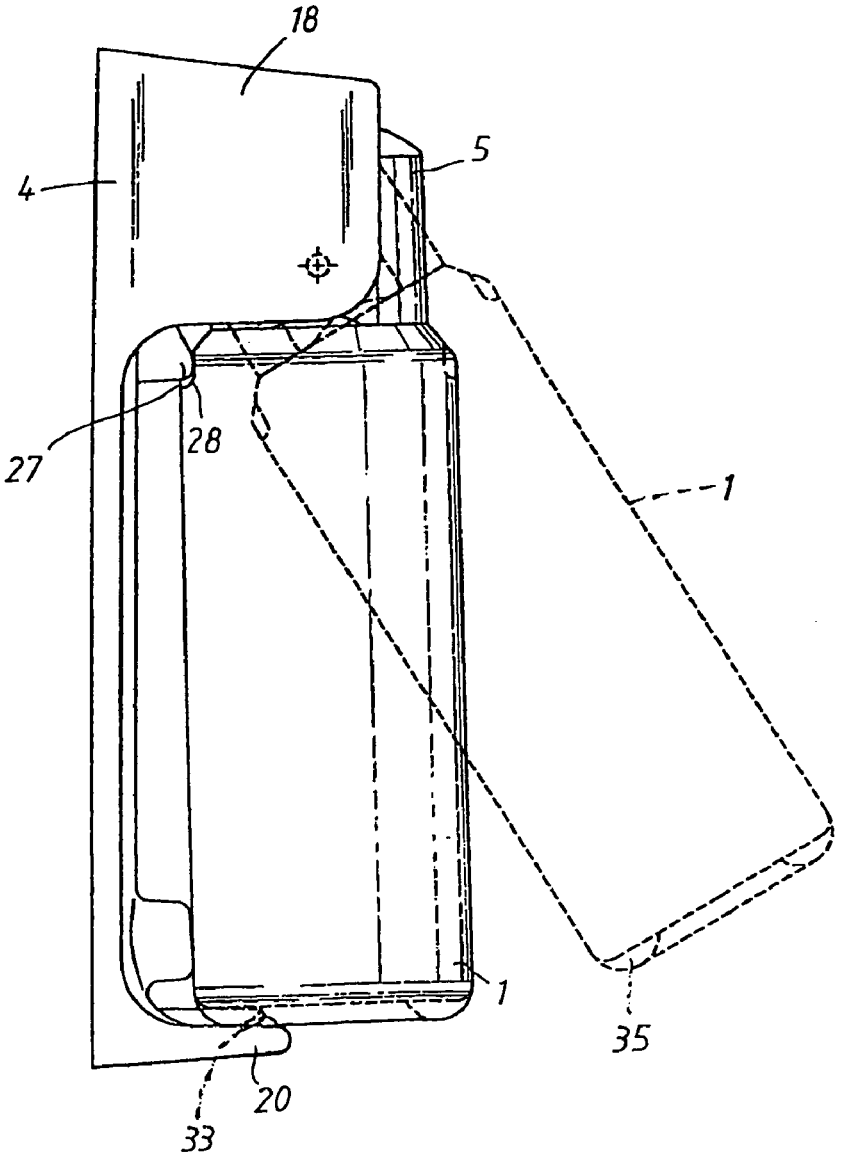
FIG. 9 illustrates an inventive flask in a holder as seen from the left in FIG. 8, and shows the flask in two different positions.
Figure 10:
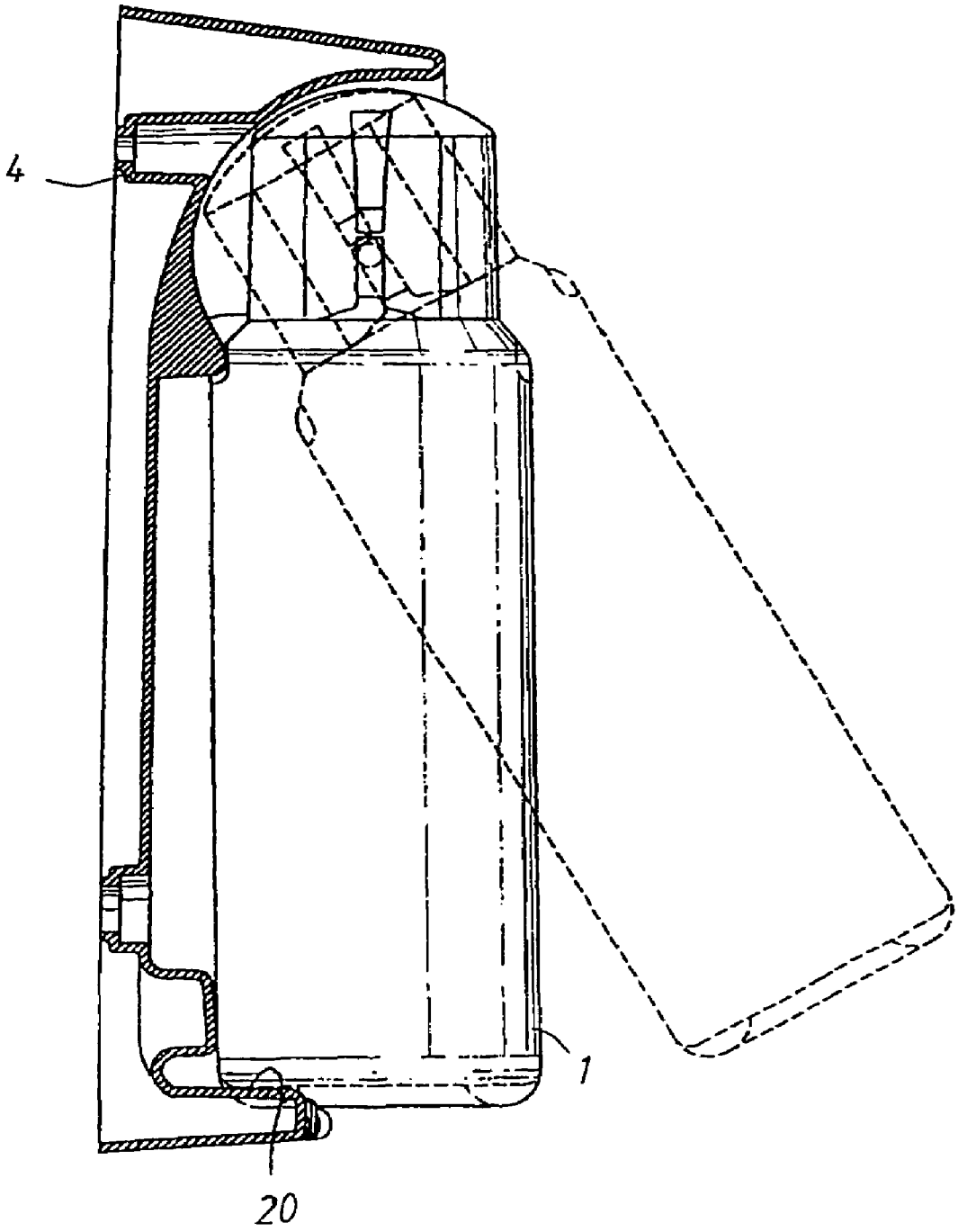
FIG. 10 is a view similar to that of FIG. 9 but with the holder cut away.

This enables the flask 1 to be readily tilted out from the holder 4 prior to rotating the flask, as illustrated in broken lines in FIG. 9.

The intention is that it shall be possible to press a fresh flask into the holder or to push the flask into the holder from its bottom, by virtue of the projections 23, 24 being sprung to one side under the influence of the swung portions of the sleeve 5. However, when the sleeve is in place the flask cannot be removed from the holder without the flask being opened.

The projections 23, 24 spring back into the grooves 21, 22, when the flask 1 is in position. When the flask is placed on the supporting plane 20 of the holder, the resilient projections 23, 24 will be located in the vicinity of the underside of respective shoulders 25, 26.

The springy projections 23, 24 may be formed from a springy plastic material. However, the projections may alternatively be provided by a spring-loaded metal cylinder, in a known fashion.

After having twisted the flask 1 and removed it from its holder 4, the sleeve 5 will fall down to the floor as a result of its center-of-gravity position having been rotated through one half of a revolution around the projections 23, 24, provided that the shoulders 25,26 are placed sufficiently far down in the grooves 21,22. This signifies that the sleeve 5 is not a re-usable part of the device.

According to one preferred embodiment of the invention, the holder 4 is provided with a projection 27 (see FIG. 9) intended for co-action with a recess 28 in the parallel surface of the flask 1, so that the flask can only be retentively inserted into the holder when the flask is rotated to a position in which the projection 27 engages the recess 28, as shown in FIG. 9. The correct rotational position is indicated by virtue of the fact that the sleeve 5 is narrower in the FIG. 5 illustration than in the FIG. 7 illustration (see also FIG. 6), where the distance between the outwardly facing walls 18, 19 corresponds to the narrower measurement of the sleeve. Thus, if the flask is not rotated to the aforesaid rotational position, it will not be possible to insert the bottom of the flask over said support 20.

The support 20 includes an elevated portion 31 which is intended to co-act with a corresponding groove 32 in the flask, said elevation making it at least difficult to insert a flask that has an incorrect rotational position.

The support 20 also includes two beads 33, 34 that function to engage in the roll 35 of the flask 1 and therewith secure the flask both laterally and longitudinally.

Although the sleeve 5 and that part of the closure element 2 which accompanies the sleeve can be placed back on the flask, it cannot be fastened at said part of the closure element that remains on the flask. Neither can the sleeve be fastened to the eye cup. This means that the sleeve may have any chosen position of rotation relative to the flask. It also means that the narrower dimension of the sleeve will give no indication as to where the recess 28 in the flask is located. It is therefore difficult to align the recess 28 with the projection 27 on the holder 4.

This embodiment makes it difficult to return an opened flask to the holder.

The flask 1, the eye cup 3, and the sleeve 5 are formed from an appropriate plastic material. The holder 4 may be made of plastic, wood, or metal.

It will be evident that the inventive device fulfils all of the aforesaid desiderata.

Although a number of embodiments have been described above, it will be obvious that the flask and the holder can be modified by the person skilled in this art with regard to structural elements.

The invention shall not therefore be considered restricted to the aforedescribed exemplifying embodiments thereof, as variations and modifications can be made within the scope of the accompanying claims.

What is claimed is:

1. An eye rinsing device comprising a flask for an eye rinsing liquid, wherein the flask has a longitudinal axis and is sealed closed by an integrally formed closure element that prevents liquid flow from the flask and that projects up from a future opening of said flask, wherein the flask includes means for connection of the flask with a flask holder, an eye cup surrounding the closure element, and a sleeve surrounding the eye cup, wherein the sleeve is non-rotatably connected with the closure element, and wherein during use the closure element that projects up from the future opening is non-resealably separated from the flask to provide the opening for permitting flow of eye rinsing liquid from the flask when the flask is turned by twisting relative to the sleeve to separate it from the sleeve.

2. The device according to claim 1, wherein the closure element is non-symmetrical around the longitudinal axis of the flask and an inner part of the sleeve engages an axially asymmetrical part of the closure element, and wherein the sleeve is connected with an upper part of the closure element through a fastener element that co-acts with the closure element.

3. The device according to claim 1, wherein the closure element includes a waist situated beneath said future opening, and wherein a lower part of the eye cup engages in said waist.

4. The device according to claim 1, wherein a lower part of the sleeve lies around and against the flask.

5. The device according to claim 1, including a flask holder that includes two mutually spaced and outwardly extending walls between which said sleeve is received.

6. The device according to claim 1, including a flask holder having an outwardly directed support against which a lower portion of the flask rests.

7. The device according to claim 5, wherein said means for connection includes two mutually opposing grooves located on said sleeve parallel with the longitudinal axis of the flask, wherein the grooves co-act with a resilient projection in each of the outwardly extending walls to retain the flask in the holder.

8. The device according to claim 7, including shoulders positioned in respective grooves, wherein the shoulders are located at and above said projections when the flask, together with the sleeve, is placed in the holder, and wherein the shoulders are positioned in the grooves at a position to enable the sleeve to fall down out of the holder as a result of the position of the center-of-gravity of the sleeve having been rotated through one half of a revolution around the projections subsequent to said twisting of the flask and removing it from said holder.

9. The device according to claim 5, wherein said sleeve is narrower in one lateral direction than in a direction perpendicular thereto; and in that the distance between the outwardly extending walls of the flask holder corresponds to the narrower lateral dimension of the sleeve.

10. The device according to claim 1, including a flask holder having a projection for co-action with a recess carried by the flask, so that the flask can only be inserted retentively in the holder when the flask is rotated to a position in which the projection can be inserted into the recess.

* * * * *